United States Patent [19]

Smith

[11] 4,269,670

[45] May 26, 1981

[54] ELECTRODE FOR ELECTROCHEMICAL PROCESSES

[75] Inventor: Craig G. Smith, North Plainfield, N.J.

[73] Assignee: Bell Telephone Laboratories, Incorporated, Murray Hill, N.J.

[21] Appl. No.: 126,840

[22] Filed: Mar. 3, 1980

[51] Int. Cl.[3] ..... C25D 5/02; C25D 3/48; C25D 17/10

[52] U.S. Cl. ..... 204/15; 204/46 G; 204/290 F

[58] Field of Search ..... 204/15, 46 G, 49, 46 R, 204/52 R, 56 R, 129, 290 F

[56] References Cited

U.S. PATENT DOCUMENTS

| | | | |
|---|---|---|---|
| 3,214,355 | 10/1965 | Kandler | 204/56 |
| 3,428,544 | 2/1969 | Bianchi | 204/290 |
| 3,491,014 | 1/1970 | Bianchi | 204/242 |
| 3,562,008 | 2/1971 | Martinsons | 204/290 F |
| 3,573,101 | 3/1971 | Beauchamp | 204/56 |
| 3,616,445 | 10/1971 | Bianchi | 204/290 F |
| 3,653,967 | 4/1972 | Beauchamp | 204/56 |
| 3,689,383 | 9/1972 | De Witt | 204/290 F |
| 4,067,783 | 1/1978 | Okinaka | 204/43 G |
| 4,075,070 | 2/1978 | Du Bois | 204/290 F |
| 4,153,523 | 5/1979 | Koontz | 204/15 |
| 4,176,021 | 11/1979 | O'Sullivan | 204/96 |

OTHER PUBLICATIONS

Extended Abstracts of the Electrochemical Society Spring Meeting, May 21-26, 1978 Abstract No. 481, vol. 78-1, pp. 1202-1205.

*Primary Examiner*—T. M. Tufariello
*Attorney, Agent, or Firm*—Walter G. Nilsen

[57] ABSTRACT

An electrochemical process is described in which a particular kind of electrode is used. The electrode surface is made up of certain types of oxides. A process for preparing the electrodes is also described. Such electrodes exhibit long life and are highly efficient in that reduced electropotential is observed. This property is particularly advantageous in that it reduces power consumption for the electrochemical process and reduces undesirable side reactions in the electrochemical process. Particular processes where this electrode is useful are electrodeposition of metals such as gold, copper, nickel, and palladium, the production of chlorine and oxygen by electrolysis, electrolytic loading of electrodes for batteries, and production of electricity in fuel cells.

25 Claims, 2 Drawing Figures

ELECTRODE FOR ELECTROCHEMICAL PROCESSES

TECHNICAL FIELD

The invention is electrochemical process in which a particular type of electrode is used.

BACKGROUND OF THE INVENTION

Electrochemical processes are used in many manufacturing procedures to produce various results including metallic films, gaseous products, oxidized surfaces, and various chemical compounds as in certain chemical synthesis procedures. Many of these electrochemical procedures require electrodes which are stable, highly catalytic and long lasting. Electrodes play various roles in electrochemical processes. They may be used as anodes where product is produced (i.e., electrolytic production of chlorine) or as a counter-electrode for electroplating, etc. Indeed, for many processes, a non-consumable anode is required. Exemplary processes are electrodeposition of metals such as gold, nickel, copper, palladium, etc. Included in such processes is electrolytic formation of powdered metals such as powdered copper. Other exemplary processes are electrolytic loading of electrodes for batteries as, for example, in the production of nickel electrodes and cadmium electrodes for nickel-cadmium batteries.

Electrodes are useful for many other electrochemical processes. Certain compounds, especially organic compounds, are produced by electrochemical procedures where an inert or counter-electrode is used. Such an electrode may be either anode or cathode. Another exemplary use of electrodes is in fuel cells. Again, the electrode may be either anode or cathode.

Because of the extensive use of electrochemical procedures in manufacturing processes, it is highly advantageous to use electrodes which are both efficient and long lasting. Efficiency is advantageous not only to minimize power consumption, but also because it minimizes undesirable side reactions which are both costly and complicate many industrial processes. Minimizing power consumption also is advantageous because of the energy saved and the reduction in heat produced in industrial processes.

A variety of anodes have been described in the literature. Particular references are the following: U.S. Pat. No. 3,428,544 (Guiseppe Bianchi et al issued Feb. 18, 1969); U.S. Pat. No. 3,491,014 (Guiseppe Bianchi et al, issued Jan. 20, 1970); U.S. Pat. No. 3,616,445 (Guiseppe Bianchi, issued Oct. 26, 1971); and Extended Abstracts of the Electrochemical Society Spring Meeting, Seattle, Washington, May 21–26, 1978, Volume 78-1, pp. 1202–1205. Also of interest is a recently issued patent (U.S. Pat. No. 4,067,783, issued Jan. 10, 1978, Okinaka et al).

SUMMARY OF THE INVENTION

The invention is an electrochemical process in which a particular type of electrode is used as a nonconsumable electrode. A particular procedure is used to make the electrodes. The surface of the electrode comprises oxides of three groups of metals. Here, this oxide coating is called the active oxide coating. The first group is the group VIII metals comprising cobalt, nickel, ruthenium, rhodium, palladium, iridium and platinum. The metal oxides of ruthenium and iridium are preferred because of good catalytic effect (generally measured by low electrode potential to electrolyze water) particularly at high current densities (say above 50 ASF). The second group is the oxides of valve metals, namely titanium, zirconium, hafnium, vanadium, niobium, and tantalum. The oxides of titanium, hafnium, niobium and tantalum are preferred with tantalum and hafnium most preferred. Generally, tantalum is preferred with iridium, and hafnium is preferred with ruthenium. The third group is the oxides of alkaline metals and rare earth metals (including group IIIB metals) such as beryllium, calcium, strontium, barium, scandium, yttrium, lanthanum and the rare earth elements with atomic numbers 58–71. For convenience, these metal oxides are referred to as binder metal oxides. The oxides of calcium, strontium, barium, scandium, and yttrium are preferred with barium and lanthanum most preferred because they yield electrodes of longest life under high current conditions. Barium is most preferred with the iridium-tantalum combination and lanthanum is most preferred with the ruthenium-hafnium combination. The composition of the active oxide coating may vary over large limits. Satisfactory results are obtained if the group VIII oxides are present to the extent of at least 10 mole percent, the valve metal oxides to the extent of at least 10 mole percent and the binder metal oxides to the extent of at least 5 mole percent. Preferred compositions are with the mole ratio of group VIII metal oxide to valve metal oxide between $\frac{1}{4}$ and 4 and the range of binder metal oxide is from 5 to 50 mole percent. Most preferred is the range from 5 to 20 mole percent. Such electrodes have high catalytic effect, minimum undesirable side reactions, and long catalytic lifetime, particularly at high current densities.

DETAILED DESCRIPTION

Figure 1:
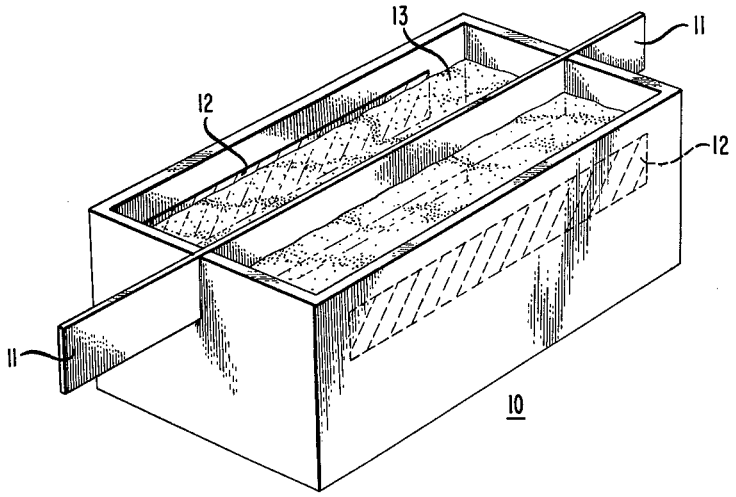
FIG. 1 is a perspective view of a typical strip plating cell showing electrode made in accordance with the invention.

The invention is an electrochemical process in which a special type of electrode is used. The electrode is made up of a substrate and a surface coating of metal oxide which covers at least part of the substrate surface. This surface coating of metal oxide is referred to as the active oxide coating. The substrate may be any substance that is compatible with the electrochemical process. Generally, it should be chemically inert to the chemicals used in the elecrochemical process and be sufficiently conductive to pass the current used in the electrochemical process. Generally, the substrate is metallic. Typical substrates are made of titanium, niobium, tantalum or alloys of these metals. Particularly convenient is an alloy of niobium and tantalum.

The surface of the electrode is at least partially covered with a mixture of metal oxides. This mixture of oxides contains at least one metal oxide from each of three groups of metal oxides. These three groups of metal oxides are identified above as is the compositional range useful in the practice of the invention. Often, the most preferred composition (ratio of group VIII metal oxide to valve metal oxide) depends on the particular application. Specifically, where the electrolyte to which the electrode is exposed exhibits good solubility characteristics for the group VIII metal oxide, it is preferred that the mole ratio (group VIII to valve metal oxide) be low, say between ½ and 1. Good solubility conditions include high bath temperature (e.g., above 50 degrees C.), low pH (less than 6) and the presence of a strong complexing agent for the group VIII metal oxide (i.e., cyanide ion). For low temperatures (below 50 degrees C.), high pH (above 6) and absence of strong complexing agent, a mole ratio between 2 and 3 is most preferred.

The electrodes can be prepared in a variety of ways including adhering a mixture of the oxides to the surface of the electrode. Good mixing of the oxides is preferred so as to yield as uniform a mixture of oxides as is practical. Particularly important is the use of a heat treatment in the range from 400 degrees C. to 500 degrees C. which increases catalytic activity and electrode lifetime.

A particularly convenient method of applying the oxide coating to the electrode is to use dilute solutions of metal salts and apply the solution to the electrode substrate. The metal compounds are then converted to the oxide by heating in an oxygen containing atmosphere (i.e., air or oxygen-enriched atmosphere). Generally, the metal chlorides are used and a titanium screen serves as the electrode substrate. It is preferred that in heating the soaked electrode that the temperature is raised rapidly (preferably within 5 minutes) so as to minimize evaporation of the metal salt and maximize conversion to the oxide. A heat source (for example, a large metal block which conducts heat rapidly, such as an aluminum or copper block) inside an oven is conveniently used for this purpose. It is also preferred that the soaked substrate be heat treated in the range between 400 degrees C. and 500 degrees C. for at least 5 minutes. The preferred time of treatment is from 15 minutes to 2 hours with from 45 minutes to one hour most preferred. It is observed that heat treatment in this temperature range increases catalytic activity and increases electrode lifetime. Temperature range between 400 degrees C. and 450 degrees C. is most preferred because it ensures this increased catalytic activity and increased lifetime while minimizing evaporation of the metal chlorides and ensuring maximum conversion to the metal oxide.

Another important aspect of the invention is the importance of keeping the metal salt (metal chloride) layer thin before conversion to the oxide. This ensures complete conversion to the oxide. It is also believed that much of the improvement in the electrodes depends on the formation of mixed oxide of the group VIII metal and binding metal (i.e., the mixed oxide of barium and iridium such as $BaIrO_3$ or of lanthanum and ruthenium, such as $LaRuO_3$). From X-ray diffraction experiments, it appears that use of thin layers of the metal salts (i.e., chlorides) leads to a greater yield of the mixed oxides. Also, use of the temperature range between 400 and 500 degrees C. also increased the yield of mixed oxide. Although the evidence is not conclusive, it appears that formation of mixed oxide is at least partly responsible for the electrode characteristics. The presence of at least 5 mole percent mixed oxide is believed to be effective in increasing electrode lifetime and catalytic activity.

A detailed procedure for the preparation of the electrode is given below. In this procedure, a titanium substrate is used and the metal oxides are tantalum oxide, iridium oxide, and barium oxide.

First, the substrate surface is prepared so as to remove foreign matter and oxides from the surface. This generally is done by dry honing the substrate surface.

Second, a coating solution is prepared as follows: A solution of iridium compound is prepared in a solvent which dissolves iridium, tantalum, and barium compounds. Then a solution of a tantalum compound is prepared in a solvent which dissolves tantalum, iridium, and barium compounds. A third solution of barium compound is made in a solvent which when added to the two solutions described above will result in a solution of the three metal compounds. The solutions should be sufficiently dilute to ensure against precipitation of any of the components of the solution. Also, dilute solutions ensure reasonable uniform application of the metal compounds.

The three solutions are mixed together in proportions that yield the desired composition of metal oxides.

A specific procedure for preparation of the coating solution might be useful in understanding the invention. The volume of solution required depends on the area of electrode to be covered. Best results are obtained with a volume of approximately 0.083 ml/sq cm of electrode area to be covered. The final solution is made by adding appropriate amounts of the individual solutions so as to make up the composition of metal that is desired.

The solution of iridium compound is made by dissolving iridium tetrachloride in (20 weight percent) hydrochloric acid at 70 degrees C. Sufficient iridium compound is used to make a 0.06 molar solution. After the iridium tetrachloride is dissolved, the solution is allowed to cool.

The solution of tantalum compound is made by dissolving tantalum pentachloride in methanol. The tantalum pentachloride should be added slowly to prevent splattering and the solution stirred rapidly. Sufficient tantalum compound is added to make a 0.06 molar solution.

The barium solution is made by adding barium chloride to water. Sufficient barium chloride is added to make a 0.06 molar solution.

It is preferred that the solutions are prepared immediately before the coating procedure. The solutions are mixed together and cooled. The container holding the solution should be covered to prevent evaporation of the methanol.

Since the three solutions have the same molar concentration, the desired composition of the coating can be determined on a weight ratio basis. For example, for a mole ratio (platinum to valve metal oxide) of 1, equal weights of the iridium and tantalum solutions are mixed together. To make a final solution of 20 mole percent barium, remainder equal parts of iridium and tantalum, 20 weight percent barium solution is added to the iridium-tantalum solution (i.e., 20 grams binder solution to 80 grams of the mixed Ir-Ta solution).

Immediately before applying the coating, the surface of the substrate is etched with acid (preferably hydrochloric acid for fifteen minutes) and then dried. The substrate is then exposed to the solution of metal compounds prepared above. The electrode surface is then dried, generally in a hood, to provide adequate ventilation. A heat gun or other source of heat may be used. It is preferred that drying be reasonably slow, say at least one minute. This soaking and drying procedure is repeated 3 or 4 times. Generally, it is advantageous to avoid building up too thick a layer before conversion to the oxide. Thin layers are more easily converted to the oxide and perhaps yield more mixed oxide. Also use of relatively thin layers minimized loss of the chlorides prior to conversion to the oxide. The substrate is then baked for a short time (5 to 30 minutes) at approximately 400 degrees C. and then cooled rapidly to room temperature. A cold metal block may be used to affect rapid cooling.

This procedure may be repeated a number of times in order to build up the thickness of metal oxide mixture on the surface of the electrode. After sufficient thickness is obtained, the electrode is baked in air for approximately one hour at 450 degrees C.

These electrodes are useful in a variety of electrochemical processes, including electrodeposition of metals such as gold, palladium, nickel, copper, etc., electrolytic loading such as in the fabrication of nickel electrodes and cadmium electrodes for nickel-cadmium batteries and various synthesis procedures for organic compounds. Typical electrochemical procedures are described in a variety of references including *Metal Finishing,* published annually by Metals and Plastics Publications, Incorporated, Hackensack, N.J.; and *Electrochemistry of Organic Compounds* by A. P. Tomilov et al, John Wiley & Sons, 1972.

Typical procedures for gold plating processes are as follows: A series of anodes are made up in accordance with the procedure described above. The following anode compositions are useful: The numbers refer to mole percent.

1. 10 Ir, 10 Ta, remainder Ba
2. 10 Ir, 40 Ta, remainder Ba
3. 40 Ir, 10 Ta, remainder Ba
4. 75 Ir, 20 Ta, remainder Ba
5. Same as numbers 1–4 but with the following elements substituted for Ir: Co, Ni, Ru, Rh, Pd and Pt.
6. Same as numbers 1–4 above but with the following elements substituted for Ta: Ti, Zr, Hf, V and Nb.
7. Same as numbers 1–4 above but with the following elements substituted for Ba: Be, Ca, Sr, Sc, Y, La, and rare earth elements with atomic numbers 58 through 71.

These electrodes are used in gold plating processes using a variety of plating baths and procedures, including citrate buffered baths and phosphate buffered baths. The gold plating solution comprises 4 to 40 grams per liter gold as potassium gold cyanide, 80–100 grams per liter potassium citrate and citric acid. Another plating solution is made up of 20±10 g/l potassium gold cyanide, 50±10 g/l dibasic ammonium citrate [$(NH_4)_2HC_6H_5O_7$] and water to make one liter. Plating is preferably carried out at elevated temperatures, typically from 55 to 75 degrees C. This procedure yields excellent gold plating results with anodes described above.

Other gold plating experiments use potassium gold cyanide in a phosphoric acid buffer solution. The composition is 5–15 grams per liter potassium gold cyanide, 10–30 milliliters per liter phosphoric acid, sufficient base (i.e., potassium hydroxide) to increase the pH to approximately 7.5 to 8.5. Another electrolyte composition comprises 10–40 g/l potassium gold cyanide, 30–50 g/l dibasic potassium phosphate ($K_2HPO_4$ $3H_2O$) and 5–15 g/l monobasic potassium phosphate ($KH_2PO_4$). Preferably, the process is carried out at elevated temperature, typically from 55 to 75 degrees C. for soft gold and 35 to 45 degrees C. for hard gold. This plating procedure also yields excellent results using the electrodes described above.

Particularly attractive for the application of the electrodes is as counter-electrodes for strip line plating processes such as the gold strip line process. Such processes require high plating rates (often over 50 ASF or even over 100 ASF) to achieve high throughput rates. Also, long lifetimes are highly advantageous (particularly at high plating rates) because of the continuous nature of the process. Strip line processes are described in a variety of references including U.S. Pat. No. 4,153,523, issued to D. E. Koontz et al on May 8, 1979.

Similar results are obtained using other metal plating solutions. For nickel, the plating solution contains 330 grams per liter nickel sulfate, 45 grams per liter nickel chloride and 37 grams per liter boric acid. The plating temperature is typically 60 degrees. These plating solutions when used in combination with the electrodes described above yield excellent nickel plated films.

With palladium a typical plating bath is made up of 40 to 100 grams per gallon palladium ammonium nitrate and pH adjusted between the range of 8 and 10. This plating procedure is carried out in the temperature range between 100 and 140 degrees F. Other plating compositions are set forth in the literature including the references entitled *Metal Finishing* referred to above.

Copper plating is carried out with a variety of plating solutions generally made up of copper sulfate and sulfuric acid. A useful composition is 28 ounces per gallon copper sulfate and 7 ounces per gallon sulfuric acid. Copper plating procedures carried out with such copper plating baths and the electrodes described above yield excellent copper plated films.

Powdered metals can also be made using the electrodes described above. Particularly important is the production of powdered copper useful in a variety of applications.

Typical procedures for loading electrodes useful in batteries are outlined in several issued patents. They are U.S. Pat. No. 3,214,355, issued to L. Kandler on Oct. 26, 1965; U.S. Pat. No. 3,573,101, issued to R. L. Beauchamp on Mar. 30, 1971; U.S. Pat. No. 3,653,967 issued to R. L. Beauchamp on Apr. 4, 1972; and U.S. Pat. No. 4,176,021 issued to T. D. O'Sullivan on Nov. 27, 1979. These procedures yield excellent electrodes useful in nickel-cadmium batteries.

These electrodes are also useful in the oxidation of alcohols to acids. Such a procedure is described in detail on page 316 of the Tomilov reference given above. This reference describes a procedure for oxidizing alcohols (other than methanol) to the corresponding carboxylic acid. The use of electrodes described above yields excellent results in this oxidation procedure. The electrodes are also useful in fuel cells.

A typical impregnation procedure for nickel is as follows. The plaque (usually made of nickel) is impregnated in an acidic nickel solution. The plaque is made the cathode and an electrode, as described above, is made the anode.

Generally, the nickel in the electrolyte is added as nickel nitrate, but other anions may be used provided they are reduced more easily than the nickel ions. Although concentrations may vary over large limits, (say from 0.1 M to saturation), optimum conditions are contained in a range from (1.5–3.0 molar. Small amounts of soluble cobalt compound (usually cobalt nitrate) are added to introduce cobalt into the nickel electrode. This improves cycle life. Generally, the amount of cobalt added varies from 1 to 30 mole percent of the nickel concentration. A range of 5 to 10 mole percent is preferred. The pH should be in a range from 0.5–5.0 with the range from 1.0 to 3.5 preferred. Preferred impregnation rates are from 0.05–5 Amperes per square inch. These ranges give optimum loadings without being wasteful of time.

Because hydrogen ions are liberated during the impregnation process, some means should be used to prevent excessive acidity of the solution. This may be done in a variety of ways, including the addition of basic substances. Because regions of excessive basicity should be avoided, pH is often controlled by the addition of alkali metal nitrites. This procedure has the advantage of controlling basicity without producing regions of excessively high pH. Best results are obtained with initial concentrations of nitrite between 0.1 M and saturation.

FIG. 1 shows a typical electroplating cell 10 particularly useful in a strip line plating apparatus. The strip 11 often composed of connector pins for electrical connectors is made the cathode in the plating arrangement.

Anode 12 made in accordance with the invention is usually located inside the plating cell. The plating cell is filled with electrolyte 13 and the remainder of the cell is usually made of inert and nonconducting material such as plastic. Strip plating processes usually require high plating rates to ensure rapid movement of the strip down the assembly line. Electrodes made in accordance with the invention are highly advantageous because they permit high current densities while still maintaining low electrochemical voltage and long life.

Figure 2:
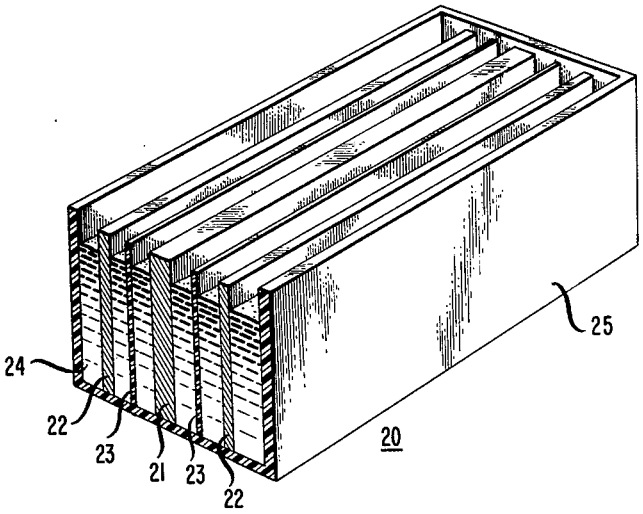
FIG. 2 is a perspective view of a cell useful for producing gaseous products showing electrode made in accordance with the invention.

FIG. 2 shows a typical arrangement used in the production of gaseous substances by electrochemical procedures. Two typical such processes are the production of chlorine gas and the production of oxygen gas. The apparatus is composed of cathode 21 and anode 22 separated by a membrane 23 that prevents liberated gases from migrating from anode to cathode. The electrodes and membrane are immersed in an electrolyte 24 which in turn is contained in an inert vessel 25 generally made of nonconducting plastic. Chlorine is liberated at the anode and collected above the apparatus. Anodes made in accordance with the invention are advantageously used in the electrolytic production of chlorine and oxygen.

What is claimed is:

1. A process for electroplating a metal on a surface comprising the step of passing current through electrode and electrolyte characterized in that the surface of at least one electrode is at least partially covered with an active oxide coating, said active oxide coating consisting essentially of oxide of at least 10 mole percent group VIII metal, at least 10 mole percent valve metal and at least 5 mole percent binder metal, said group VIII metal consisting of at least one element selected from the group consisting of cobalt, nickel, ruthenium, rhodium, palladium, iridium, and platinum, said valve metal consisting of at least one metal selected from the group consisting of titanium, zirconium, hafnium, vanadium, niobium, and tantalum, and said binder metal consisting of at least one metal selected from the group consisting of beryllium, calcium, strontium, barium, scandium, yttrium, lanthanum, and the rare earth elements with atomic numbers 58 through 71 and at least 5 mole percent of the said active oxide is in the form of mixed oxide with nominal formula $ABO_3$ with A representing binder metal and B representing group VIII metal.

2. The process of claim 1 in which the group VIII metal is iridium, the valve metal is tantalum and the binder metal is barium.

3. The process of claim 1 in which the group VIII metal is ruthenium, the valve metal is hafnium and the binder metal is lanthanum.

4. The process of claim 1 in which the mole ratio of group VIII metal to valve metal is between ¼ and 4 and the mole percent of binder metal is between 5 and 50.

5. The process of claim 4 in which the mole percent binder metal is between 5 and 20.

6. The process of claim 4 in which the mole ratio of group VIII metal to valve metal is between ½ and 1.

7. The process of claim 4 in which the mole ratio of group VIII to valve metal is between 2 and 3.

8. The process of claim 1 in which the surface of the electrode at least partially covered with oxide is metallic.

9. The process of claim 8 in which the electrode surface comprises a metal selected from the group consisting of titanium, niobium and tantalum.

10. The process of claim 1 in which the active oxide coating consists of at least 5 mole percent of mixed oxide between group VIII metal and binder metal.

11. The process of claim 10 in which the mixed oxide is selected from the group consisting of $BaIrO_3$ and $LaRuO_3$.

12. The process of claim 1 in which the electroplating process is the electrodeposition of gold.

13. The process of claim 12 in which the electrolyte comprises citrate buffer.

14. The process of claim 13 in which the electrolyte comprises 4 to 40 grams per liter gold as potassium gold cyanide, 80–100 grams per liter potassium citrate and citric acid.

15. The process of claim 13 in which the electrolyte comprises 20±10 g/l potassium gold cyanide and 50±10 g/l dibasic ammonium citrate.

16. The process of claim 12 in which the electrolyte comprises phosphate buffer.

17. The process of claim 16 in which the electrolyte comprises 5–15 g/l potassium gold cyanide, 10–30 ml/l phosphoric acid and sufficient base to increase pH to between 7.5 and 8.5.

18. The process of claim 16 in which the electrolyte comprises 10–40 g/l potassium gold cyanide, 30–50 g/l dibasic potassium phosphate and 5–15 g/l monobasic potassium phosphate.

19. The process of claim 18 in which the electrolyte is at a temperature between 55 and 75 degrees C.

20. The process of claim 18 in which the electrolyte is at a temperature between 35 and 45 degrees C.

21. The process of claim 1 in which the electroplating process is a continuous strip line procedure.

22. The process of claim 21 in which the process is a continuous procedure for the electrodeposition of gold.

23. The process of claim 1 in which the electroplating process is nickel electrodeposition.

24. The process of claim 1 in which the electroplating process is palladium electrodeposition.

25. The process of claim 1 in which the electroplating process is copper electrodeposition.

* * * * *